US008359671B1

(12) United States Patent
Glass et al.

(10) Patent No.: US 8,359,671 B1
(45) Date of Patent: Jan. 29, 2013

(54) PAIRING AND INDEXING SYSTEM FOR A GARMENT PAIR

(76) Inventors: Elizabeth Glass, West Islip, NY (US); Richard L. Miller, Dix Hills, NY (US)

( * ) Notice: Subject to any disclaimer, the term of this patent is extended or adjusted under 35 U.S.C. 154(b) by 336 days.

(21) Appl. No.: 12/803,500

(22) Filed: Jun. 29, 2010

(51) Int. Cl.
*A43B 17/00* (2006.01)
*A44B 17/00* (2006.01)

(52) U.S. Cl. ..... 2/239; 24/DIG. 29

(58) Field of Classification Search ..... 2/239, 160, 2/409, 243.1, 265; 24/380, 682.1, 687, 689, 24/696, 90.1, DIG. 29, 688, 692, 690, 691, 24/532, 662, 618, 614, 595.1
See application file for complete search history.

(56) References Cited

U.S. PATENT DOCUMENTS

| | | | | | |
|---|---|---|---|---|---|
| 2,187,296 | A | * | 1/1940 | Appel | 24/692 |
| 3,396,436 | A | * | 8/1968 | Daddona, Jr. | 24/689 |
| 3,469,290 | A | * | 9/1969 | Andrews | 24/691 |
| 3,869,766 | A | * | 3/1975 | Raymond | 24/618 |
| 5,038,413 | A | | 8/1991 | Ursino | |
| 5,321,855 | A | | 6/1994 | Ciuffo | |
| 5,357,660 | A | * | 10/1994 | Smith | 24/662 |
| 5,579,541 | A | * | 12/1996 | Christy et al. | 2/239 |
| 5,740,558 | A | | 4/1998 | Messman | |
| 5,970,524 | A | * | 10/1999 | Becker et al. | 2/239 |
| 5,974,590 | A | * | 11/1999 | Stubbs | 2/239 |
| 6,032,294 | A | | 3/2000 | Dean | |
| 6,092,241 | A | | 7/2000 | Bellet | |
| 6,185,751 | B1 | | 2/2001 | Mason | |
| 6,279,169 | B1 | * | 8/2001 | Reichle | 2/239 |
| D511,888 | S | * | 11/2005 | Anton et al. | D2/980 |
| 7,150,081 | B2 | * | 12/2006 | Juan | 24/584.1 |
| 2004/0154075 | A1 | * | 8/2004 | Ferguson | 2/239 |
| 2005/0262615 | A1 | * | 12/2005 | Pietzyk-Hardy | 2/239 |
| 2008/0222778 | A1 | * | 9/2008 | Dierssen-Morice et al. | 2/239 |

* cited by examiner

*Primary Examiner* — Amy Vanatta
(74) *Attorney, Agent, or Firm* — Richard L. Miller

(57) ABSTRACT

A pairing and indexing system for a garment pair. The pairing and indexing system includes a garment pair and a fastener. The garment pair has at least one characteristic. The fastener is attached to the garment pair, replaceably attaches the garment pair to each other for pairing so as to prevent loss of either of the garment pair due to separation from one another, an inconsistent pairing of the garment pair of a similar type, etc., and has at least one attribute. Each of the at least one attribute of the fastener has a predetermined correlation to a respective one of the at least one characteristic of the garment pair.

22 Claims, 6 Drawing Sheets

PAIRING AND INDEXING SYSTEM FOR A GARMENT PAIR

1. BACKGROUND OF THE INVENTION

A. Field of the Invention

The embodiments of the present invention relate to a pairing system for a garment pair, and more particularly, the embodiments of the present invention relate to a pairing and indexing system for a garment pair.

B. Description of the Prior Art

Keeping pairs of garment items together is well known to be a difficult task. Socks, gloves, hosiery, etc. easily become separated, either when stored in a drawer or when laundered. Particularly in households with children, an enormous amount of time can be wasted searching for the mate to a sock, mitten, or glove. If the mate is not found, the other member of the pair generally must be discarded.

Matching pairs of socks, gloves, hosiery, etc. is more difficult if a large number of socks, gloves, hosiery, etc are being washed, as may be the case in a hospital, nursing home, or large household. Matching pairs can be especially difficult if various pairs of socks, gloves, hosiery, etc are being laundered, which are similar in appearance, but do not match. Socks, gloves, hosiery, etc come in a variety of colors and fabrics, many of which can be difficult to distinguish under ordinary lighting conditions. Different sizes of socks, gloves, hosiery, etc can also be hard to sort out, such as when men's and women's socks of the same color and brand are laundered together.

Numerous innovations for fasteners for pairing garments utilized in pairs have been provided in the prior art, which will be described below in chronological order to show advancement in the art, and which are incorporated herein by reference thereto. Even though these innovations may be suitable for the specific individual purposes to which they address, however, they differ from the present invention in that they do not teach a pairing and indexing system for a garment pair.

(1) U.S. Pat. No. 5,038,413 to Ursino.

U.S. Pat. No. 5,038,413 issued to Ursino on Aug. 13, 1991 in U.S. class 2 and subclass 239 teaches a fastening device for securing a pair of socks together, which includes a first fastener attached to one sock of the pair and a second fastener attached to the other sock of the pair. The fasteners are releasably engageable with one another. The fastening device prevents the loss of socks due to separation from one another and the inconsistent pairing of socks of a similar type.

(2) U.S. Pat. No. 5,321,855 to Ciuffo.

U.S. Pat. No. 5,321,855 issued to Ciuffo on Jun. 21, 1994 U.S. class 2 and subclass 239 teaches a hook and loop reusable and reclosable fastening system for pairing socks, hosiery, and gloves. The fastening system is permanently attached to the socks and hosiery. A preferred embodiment includes an elastic, or other stretchable backing material, attached to each hook and loop panel, preferably, made up of thin separable strips that can move with the expansion and contraction of the sock and attachment material. Another preferred embodiment includes several thin strips of the hook and loop panels attached directly to each sock, so that the sock itself can serve as a stretchable backing material. Another preferred embodiment is that each hook and loop panel, respectively, is attached to a logo or decorative pattern on the sock to camouflage the particular hook and loop panel. The products, such as socks, hosiery, gloves, and the like can be attached by the hook and loop attachment apparatus for washing, drying, and storage.

(3) U.S. Pat. No. 5,740,558 to Messman.

U.S. Pat. No. 5,740,558 issued to Messman on Apr. 21, 1998 in U.S. Class 2 and subclass 239 teaches a device for attaching flexible articles, such as clothing items, having an edge. The device includes a flexible strip that includes an end with a sewable edge, and a second end having a fastening device. The device may be sown to an edge of the flexible article, such as a pair of socks, allowing the user to temporarily join a pair of socks, for example, by taking at least two of the flexible strips and stitching the sewable edge of each flexible strip to an edge of each of the socks of a pair of socks. This allows the fastening of the second end of one flexible strip to the second end of the other flexible strip, so that the clothing items may be secured together when they are not being worn.

(4) U.S. Pat. No. 6,032,294 to Dean.

U.S. Pat. No. 6,032,294 issued to Dean on Mar. 7, 2000 in U.S. class 2 and subclass 239 teaches a sock pair or glove pair having a first and a second sock or glove and at least one snap fastener. Each snap fastener has a male part, a female part, and two securing parts. At least one snap fastener is a retaining snap fastener. Each sock or glove has a U-shaped fabric tab folded over the upper or wrist edge of the sock or glove. The tab is retained on the sock or the glove by the male or the female part and one of the securing parts of the retaining snap fastener. The retaining snap fastener is located at a fastener distance from the upper or wrist edge of the sock or glove. The fastener distance is at least the fastener width, and may be up to 2.5 times the fastener width. At least one of the tabs has an indicia indicating the source of the sock or glove. The inner and outer distal edges of each tab, preferably, conform to the shape of the snap fastener holding the tab on. The glove or sock pair is comfortable, durable, and particularly suited for inexpensive mass production by machine. The pair can be easily mated when desired for laundering or storage.

(5) U.S. Pat. No. 6,092,241 to Bellet.

U.S. Pat. No. 6,092,241 issued to Bellet on Jul. 25, 2000 in U.S. class 2 and subclass 239 teaches socks, and, more particularly, to socks having a complementary mate, which enable a pair of socks to be fastened together when not being worn or during laundering and drying.

(6) U.S. Pat. No. 6,185,751 to Mason.

U.S. Pat. No. 6,185,751 issued to Mason on Feb. 13, 2001 in U.S. class 2 and subclass 239 teaches a device for attaching articles of clothing together. The device utilizes paired fasteners on each of the two articles of clothing to be attached together. This allows the two articles to either be attached together or turned inside out and folded upon themselves and attached to themselves. In this folded-down state, the fasteners are hidden from view.

It is apparent that numerous innovations for fasteners for pairing garments utilized in pairs have been provided in the prior art that are adapted to be used. Furthermore, even though these innovations may be suitable for the specific individual purposes to which they address, however, they would not be suitable for the purposes of the embodiments of the present invention as heretofore described, namely, a pairing and indexing system for a garment pair.

2. SUMMARY OF THE INVENTION

Thus, an object of the embodiments of the present invention is to provide a pairing and indexing system for a garment pair, which avoids the disadvantages of the prior art.

Briefly stated, another object of the embodiments of the present invention is to provide a pairing and indexing system for a garment pair. The pairing and indexing system includes a garment pair and a fastener. The garment pair has at least one characteristic. The fastener is attached to the garment pair, replaceably attaches the garment pair to each other for pairing so as to prevent loss of either of the garment pair due to separation from one another, an inconsistent pairing of the garment pair of a similar type, etc., and has at least one attribute. Each of the at least one attribute of the fastener has a predetermined correlation to a respective one of the at least one characteristic of the garment pair.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

3. BRIEF DESCRIPTION OF THE DRAWING

The figures of the drawing are briefly described as follows.

Figure 2:
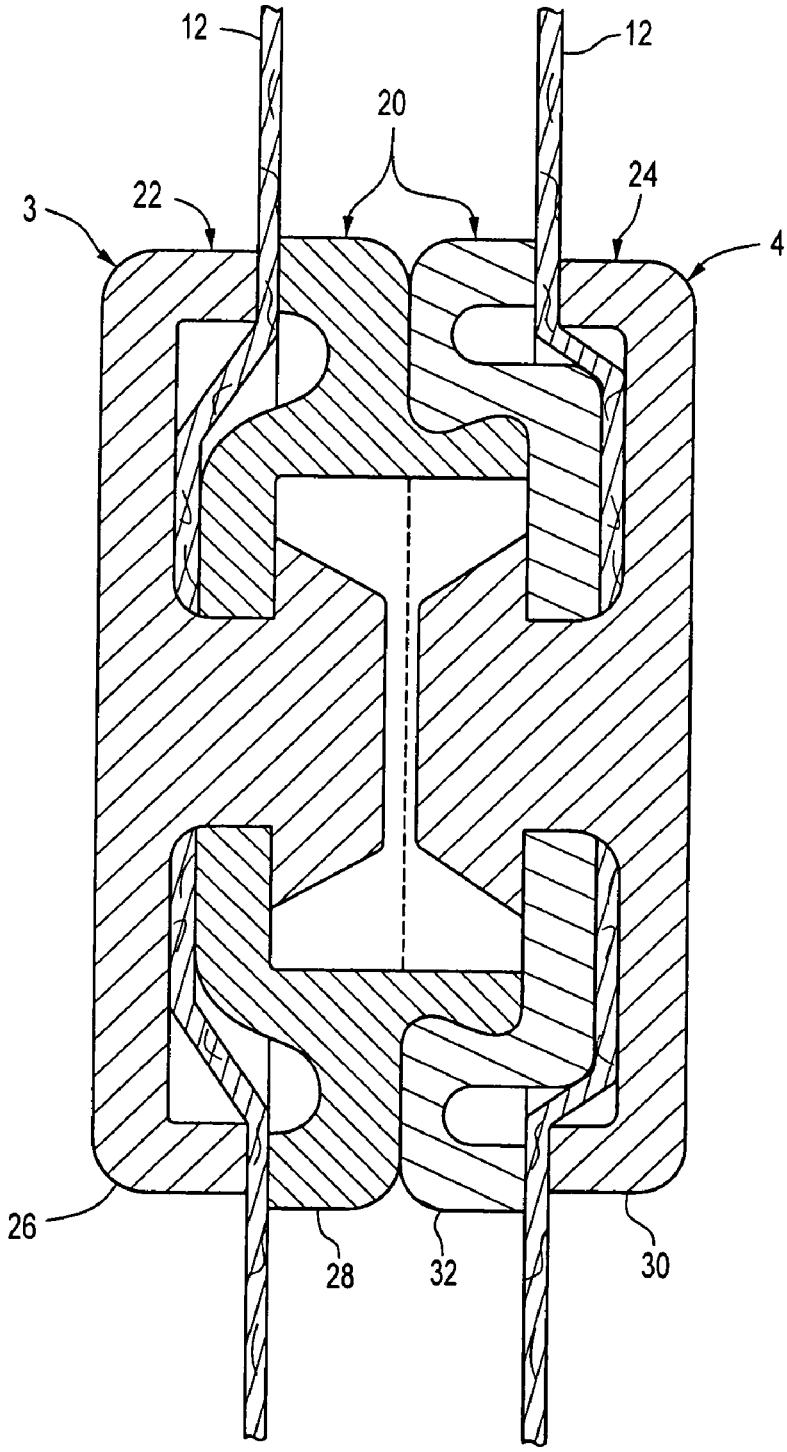
FIG. 2 is an enlarged diagrammatic cross sectional view of the snap fastener of the fastener of the pairing and indexing system of the embodiments of the present invention engaged and enclosed by the dotted curve identified by ARROW 2 in FIG. 1.
Figure 3:
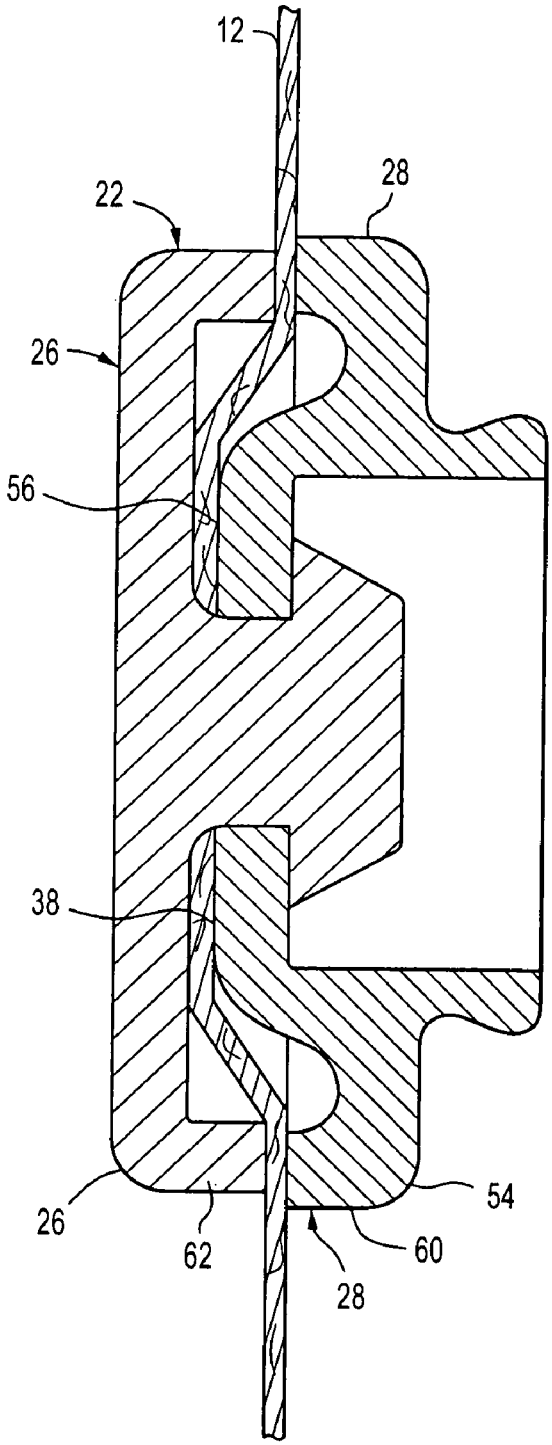
Figure 4:
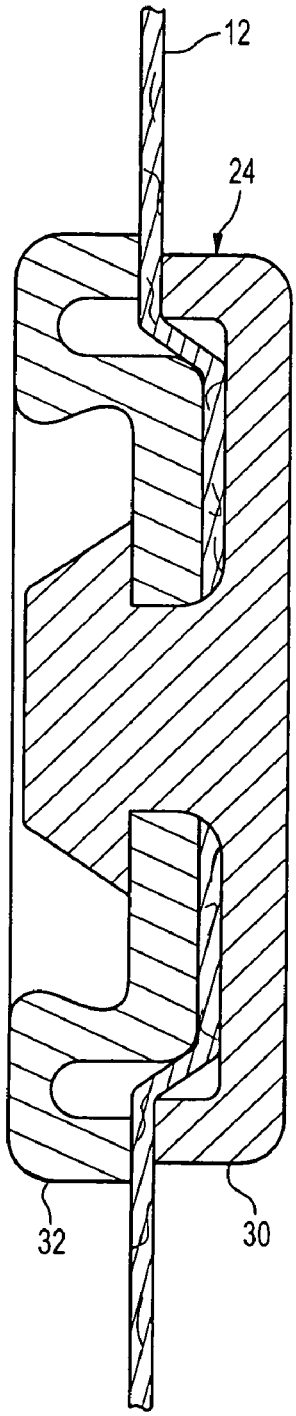
Figure 5:
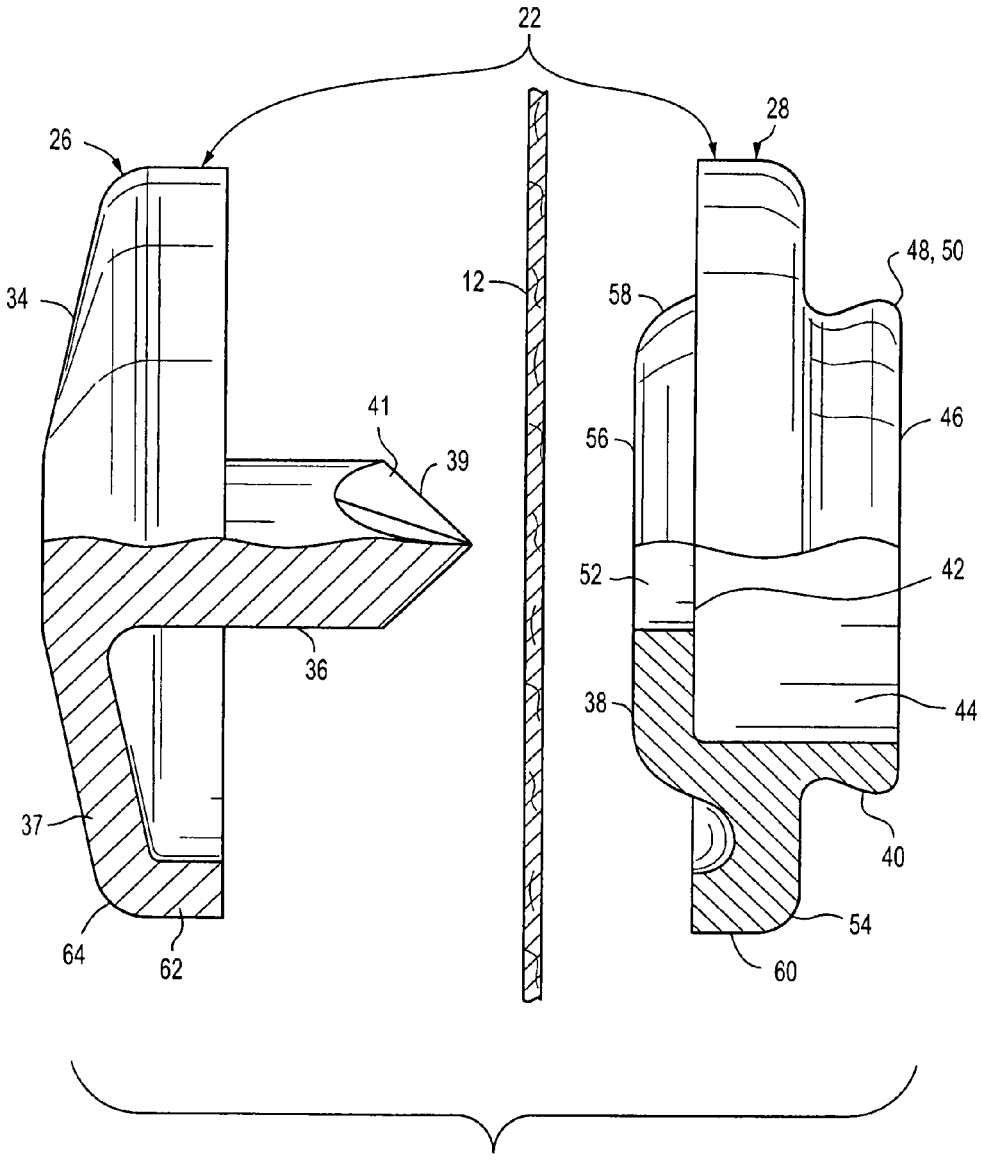
Figure 6:
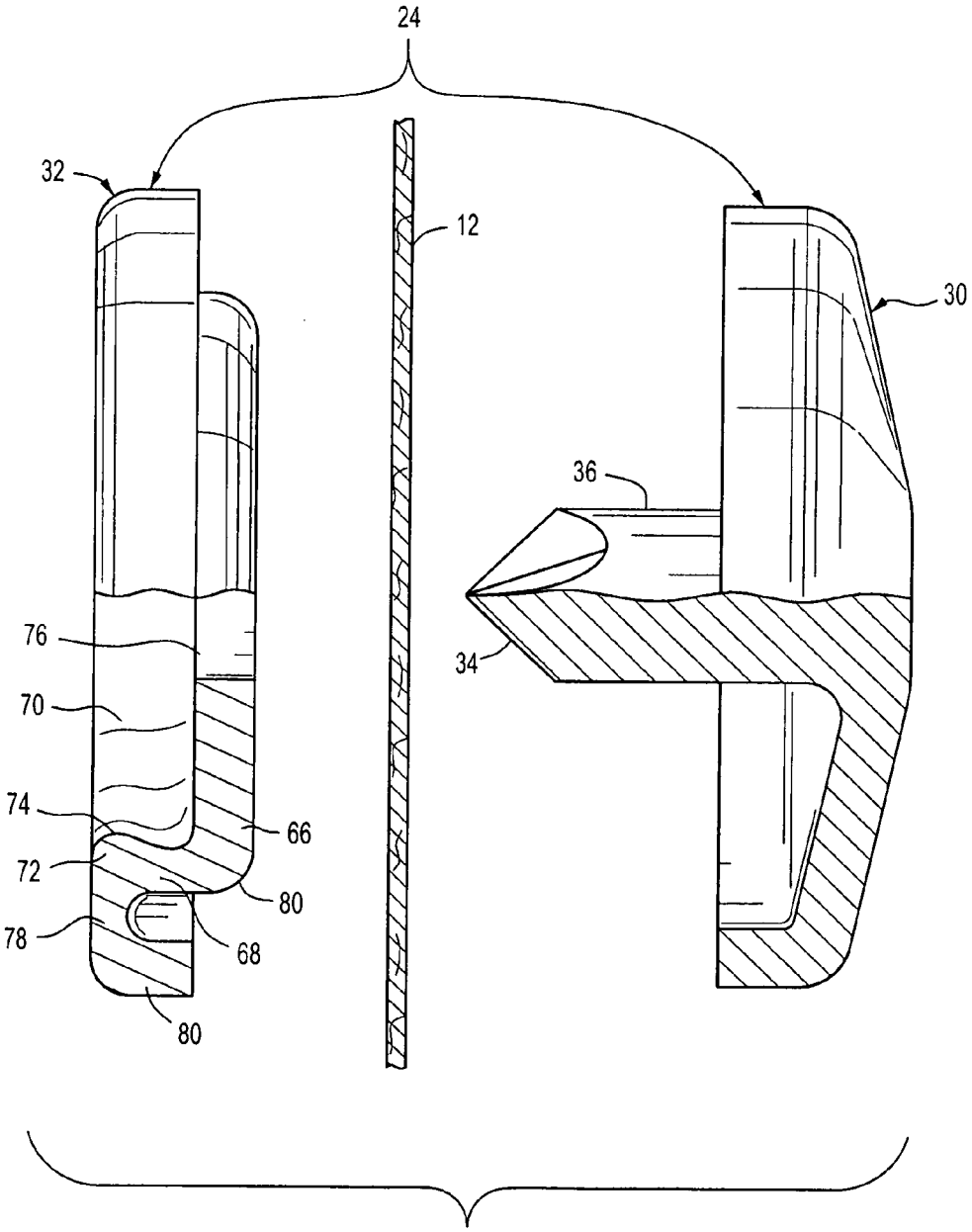

TABLE I is a tabulation of examples of each attribute of the snap fastener of the fastener of the pairing and indexing system of the embodiments of the present invention and their predetermined correlation to a respective one of the at least one characteristic of the garment pair;

TABLE II is a tabulation of EXAMPLE V of TABLE I;

TABLE III is a tabulation of EXAMPLE VI of TABLE I;

FIG. 3 is a diagrammatic side elevational view of the male portion of the snap fastener of the fastener of the pairing and indexing system of the embodiments of the present invention identified by ARROW 3 in FIG. 2;

FIG. 4 is a diagrammatic side elevational view of the female portion of the snap fastener of the fastener of the pairing and indexing system of the embodiments of the present invention identified by ARROW 4 in FIG. 2;

FIG. 5 is an exploded diagrammatic side elevational view of the male portion of the snap fastener of the fastener of the pairing and indexing system of the embodiments of the present invention shown in FIG. 3; and FIG. 6 is an exploded diagrammatic side elevational view of the female portion of the snap fastener of the fastener of the pairing and indexing system of the embodiments of the present invention shown in FIG. 4.

4. LIST OF REFERENCE NUMERALS UTILIZED IN THE DRAWING

| | |
|---|---|
| A. | General. |
| 10 | pairing and indexing system of embodiments of present invention for garment pair |
| 12 | garment pair |
| B. | Overall configuration of pairing and indexing system 10. |
| 14 | fastener |
| 16 | at least one characteristic of garment pair 12 |
| 18 | at least one attribute of fastener 14 |
| 20 | snap fastener of fastener 14 |
| C. | Overall configuration of snap fastener 20. |

-continued

| | |
|---|---|
| 22 | male portion of snap fastener 20 |
| 24 | female portion of snap fastener 20 |
| 26 | securing component of male portion 22 of snap fastener 20 |
| 28 | operative component of male portion 22 of snap fastener 20 |
| 30 | securing component of female portion 24 of snap fastener 20 |
| 32 | operative component of female portion 24 of snap fastener 20 |
| D. | Specific configuration of male portion 22 of snap fastener 20. |
| 34 | cap of securing component 26 of male portion 22 |
| 36 | pin of securing component 26 of male portion 22 |
| 37 | flange of cap 34 of securing component 26 of male portion 22 |
| 38 | base of operative component 28 of male portion 22 |
| 39 | terminal end of pin 36 of securing component 26 of male portion 22 |
| 40 | stud of operative component 28 of male portion 22 |
| 41 | plurality of grooves/flutes of terminal end 39 of pin 36 of securing component 26 of male portion 22 |
| 42 | one side of base 38 of operative component 28 of male portion 22 |
| 44 | interior of stud 40 of operative component 28 of male portion 22 |
| 46 | outer end of stud 40 of operative component 28 of male portion 22 |
| 48 | circumferential snap engaging bead of stud 40 of operative component 28 of male portion 22 |
| 50 | external surface of stud 40 of operative component 28 of male portion 22 |
| 52 | central opening of base 38 of operative component 28 of male portion 22 |
| 54 | circumferential flange of operative component 28 of male portion 22 |
| 56 | outer surface 56 of base 38 of operative component 28 of male portion 22 |
| 58 | radial outer portion of base 38 of operative component 28 of male portion 22 |
| 60 | short skirt portion of circumferential flange 54 of operative component 28 of male portion 22 |
| 62 | axially projecting lip of securing component 26 of male portion 22 |
| 64 | periphery of flange 37 of cap 34 of securing component 26 of male portion 22 |
| E. | Specific configuration of female portion 24 of snap fastener 20. |
| 66 | base of operative component 32 of female portion 24 |
| 68 | tubular section of operative component 32 of female portion 24 |
| 70 | open-mouthed cavity of tubular section 68 of operative component 32 of female portion 24 |
| 72 | plurality of lip sections of operative component 32 of female portion 24 |
| 74 | maximum radial inward projection at region of each of plurality of lip sections 72 of operative component 32 of female portion 24 |
| 76 | central opening of base 66 of operative component 32 of female portion 24 |
| 78 | circumferential flange of operative component 32 of female portion 24 |
| 80 | skirt portion of operative component 32 of female portion 24 |

5. DETAILED DESCRIPTION OF THE PREFERRED EMBODIMENTS

A. General.

Figure 1:
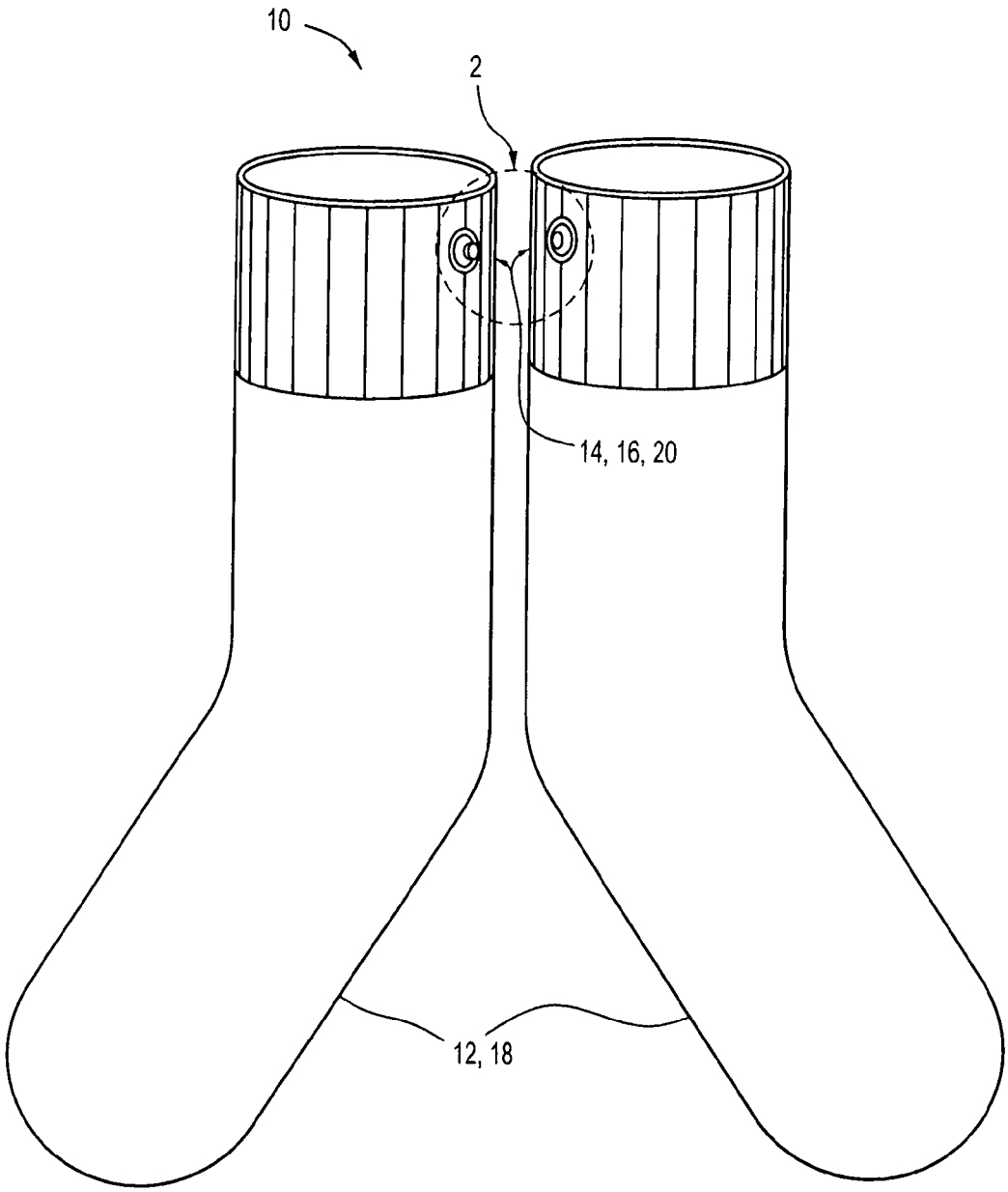
FIG. 1 is a diagrammatic perspective view of the pairing and indexing system of the embodiments of the present invention of a garment pair.

Referring now to the figures, in which like numerals indicate like parts, and particularly to FIG. 1, which is a diagrammatic perspective view of the pairing and indexing system of the embodiments of the present invention of a garment pair, the pairing and indexing system of the embodiments of the present invention is shown generally at 10 for a garment pair 12.

B. The Overall Configuration of the Pairing and Indexing System 10.

The pairing and indexing system 10 comprises the garment pair 12 and a fastener 14. The garment pair 12 has at least one characteristic 16. The fastener 14 is attached to the garment pair 12, replaceably attaches the garment pair 12 to each other for pairing, and has at least one attribute 18. Each of the at least one attribute 18 of the fastener 14 has a predetermined correlation to a respective one of the at least one characteristic 16 of the garment pair 12.

The garment pair 12 can be, preferably, socks, gloves, or hosiery, but is not limited to that.

Each of the at least one attribute 18 of the fastener 14 is, preferably, color, but is not limited to that.

The fastener 14 is, preferably, a snap fastener 20, but is not limited to that.

C. The Overall Configuration of the Snap Fastener 20.

The overall configuration of the snap fastener 20 can best be seen in FIGS. 2-4, which are an enlarged diagrammatic cross sectional view of the snap fastener of the fastener of the pairing and indexing system of the embodiments of the present invention engaged and enclosed by the dotted curve identified by ARROW 2 in FIG. 1, a diagrammatic side elevational view of the male portion of the snap fastener of the fastener of the pairing and indexing system of the embodiments of the present invention identified by ARROW 3 in FIG. 2, and a diagrammatic side elevational view of the female portion of the snap fastener of the fastener of the pairing and indexing system of the embodiments of the present invention identified by ARROW 4 in FIG. 2, and as such, will be discussed with reference thereto.

The snap fastener 20 comprises a male portion 22 and a female portion 24. The male portion 22 is attached to one of the garment pair 12, while the female portion 24 is attached to the other of the garment pair 12 so as to allow the snap fastener 20 to replaceably attach the garment pair 12 to each other for pairing.

The male portion 22 has a securing component 26 and an operative component 28, while the female portion 24 has a securing component 30 and an operative component 32.

The securing component 26 of the male portion 22 engages the operative component 28 of the male portion 22, with one of the garment pair 12 securely captured therebetween.

The securing component 30 of the female portion 24 engages the operative component 32 of the female portion 24, with the other of the garment pair 12 securely captured therebetween.

The securing component 26 of the male portion 22 and the securing component 30 of the female portion 24 are, preferably, identical to thereby simplify manufacture and assembly with attendant saving in cost, but is not limited to that.

The snap fastener 20 is, preferably, manufactured by molding or a similar process, but is not limited to that, and is made, preferably, of a suitable plastics material, such as acetal, but is not limited to that. The snap fastener 20 being plastic has advantages of being resistant to corrosive environments, easily colored to suit requirements, which is a key issue in the pairing and indexing system 10, has low heat conductivity and electrical insulating properties.

D. The Predetermined Correlation of Each of the at Least One Attribute 18 of the Snap Fastener 20 to a Respective One of the at Least One Characteristic 16 of the Garment Pair 12.

Each of the at least one attribute 18 of the fastener 14 having a predetermined correlation to a respective one of the at least one characteristic 16 of the garment pair 12 can best be seen in TABLE I, which is a tabulation of examples of each attribute of the snap fastener of the fastener of the pairing and indexing system of the embodiments of the present invention and their predetermined correlation to a respective one of the at least one characteristic of the garment pair.

For example, let's choose EXAMPLE V—highlighted on the table for the reader's convenience in location—wherein the attribute 18 of the snap fastener 20 is "Color group E" and the correlating characteristic 16 of the garment pair 12 is "Color".

As can be seen from TABLE II, which is a tabulation of EXAMPLE V of TABLE I, and in which COMBINATION 2 has been chosen and highlighted for the reader's convenience in location, the securing component 26 of the male portion 22, the operative component 28 of the male portion 22, the securing component 30 of the female portion 24, the operative component 32 of the female portion 24, and the garment pair 12 are of the same "Color 2".

This means that the garment pair 12 are of the same color as the securing component 26 of the male portion 22, the operative component 28 of the male portion 22, the securing component 30 of the female portion 24, and the operative component 32 of the female portion 24, what ever predetermined color "Color 2" happens to be. For another example, let's choose EXAMPLE VI—highlighted on the table for the reader's convenience in location—wherein the attribute 18 of the snap fastener 20 is "Color group F" and the correlating characteristic 16 of the garment pair 12 is "Weight".

As can be seen from TABLE III, which is a tabulation of EXAMPLE VI of TABLE I, and in which COMBINATION 2 has been chosen and highlighted for the reader's convenience in location, the securing component 26 of the male portion 22 and the securing component 30 of the female portion 24 are of "Color 2", the operative component 28 of the male portion 22 and the operative component 32 of the female portion 24 are of "Color 3", and the garment pair 12 are of "Median Weight".

This means that the garment pair 12 are of median weight when the securing component 26 of the male portion 22 and the securing component 30 of the female portion 24 are of "Color 2", and the operative component 28 of the male portion 22 and the operative component 32 of the female portion 24 are of "Color 3", what ever predetermined colors "Color 2" and "Color 3" happen to be.

E. The Specific Configuration of the Male Portion 22 of the Snap Fastener 20.

The specific configuration of the male portion 22 of the snap fastener 20 can best be seen in FIG. 5, which is an exploded diagrammatic side elevational view of the male portion of the snap fastener of the fastener of the pairing and indexing system of the embodiments of the present invention shown in FIG. 3, and as such, will be discussed with reference thereto.

The securing component 26 of the male portion 22 has a cap 34. The cap 34 of the securing component 26 of the male portion 22 is disk-like.

The securing component 26 of the male portion 22 further has a pin 36. The pin 36 of the securing component 26 of the male portion 22 extends normally and centrally from the cap 34 of the securing component 26 of the male portion 22, is able to pierce a respective one of the garment pair 12 without a need for a preformed hole, and is adapted to be deformed to secure the securing component 26 of the male portion 22 and the operative component 28 of the male portion 22 together, with the garment pair 12 securely captured therebetween.

The cap 34 of the securing component 26 of the male portion 22 has a flange 37. The flange 37 of the cap 34 of the securing component 26 of the male portion 22 is, preferably, circular, but is not limited to that.

The pin 36 of the securing component 26 of the male portion 22 has a terminal end 39. The terminal end 39 of the pin 36 of the securing component 26 of the male portion 22 is, preferably, pointed so as to allow the terminal end 52 of the pin 36 of the securing component 26 of the male portion 22 to pierce one of the garment pair 12 thereby avoiding a need for a preformed hole.

The terminal end 39 of the pin 36 of the securing component 26 of the male portion 22 has a plurality of grooves/flutes 41. The plurality of grooves/flutes 41 of the terminal end 52 of the pin 36 of the securing component 26 of the male portion 22 extend longitudinally along the terminal end 52 of the pin 36 of the securing component 26 of the male portion 22 and function to cut one of the garment pair 12 so as to facilitate continued penetration of the pin 36 of the securing component 26 of the male portion 22 through a variety of materials of the garment pair 12, including leather, vinyl, and multi-layer cottons, but is not limited to that.

The operative component 28 of the male portion 22 has a base 38. The base 38 of the operative component 28 of the male portion 22 is of circular shape.

The operative component 28 of the male portion 22 further has a stud 40. The stud 40 of the operative component 28 of the male portion 22 is hollow, cylindrical, and extends axially from one side 42 of the base 38 of the operative component 28 of the male portion 22.

The stud 40 of the operative component 28 of the male portion 22 has an interior 44. The interior 44 of the stud 40 of the operative component 28 of the male portion 22 is open and accessible from an outer end 46 of the stud 40 of the operative component 28 of the male portion 22, which is remote from the base 38 of the operative component 28 of the male portion 22.

The stud 40 of the operative component 28 of the male portion 22 has a circumferential snap engaging bead 48. The circumferential snap engaging bead 48 of the stud 40 of the operative component 28 of the male portion 22 is disposed around an external surface 50 of the stud 40 of the operative component 28 of the male portion 22, at the outer end 46 of the stud 40 of the operative component 28 of the male portion 22, and cooperatively engages with the female portion 24.

The pin 36 of the securing component 26 of the male portion 22 projects through one of the garment pair 12 so as to allow the flange 37 of the cap 34 of the securing component 26 of the male portion 22 to bear against one side of one of the garment pair 12.

The base 38 of the operative component 28 of the male portion 22 has a central opening 52. The central opening 52 of the base 38 of the operative component 28 of the male portion 22 receives the pin 36 of the securing component 26 of the male portion 22, with the base 38 of the operative component 28 of the male portion 22 positioned over the pin 36 of the securing component 26 of the male portion 22 and engaged with one of the garment pair 12, and with the terminal end 39 of the pin 36 of the securing component 26 of the male portion 22 projecting into the interior 44 of the stud 40 of the operative component 28 of the male portion 22 so as to allow the securing component 26 of the male portion 22 and the operative component 28 of the male portion 22 to be secured together when the terminal end 39 of the pin 36 of the securing component 26 of the male portion 22 is deformed thereby preventing withdrawal, with one of the garment pair 12 captured between the base 38 of the operative component 28 of the male portion 22 and the flange 37 of the cap 34 of the securing component 26 of the male portion 22.

It is preferred that material locking means be provided so as to provide a secure clamping of one of the garment pair 12 between the male portion 22 and the female portion 24.

To this end, the operative component 28 of the male portion 22 further has a circumferential flange 54. The circumferential flange 54 of the operative component 28 of the male portion 22 extends therearound spaced axially from an outer surface 56 of the base 38 of the operative component 28 of the male portion 22 that engages one of the garment pair 12.

The base 38 of the operative component 28 of the male portion 22 has a radial outer portion 58. The radial outer portion 58 of the base 38 of the operative component 28 of the male portion 22 curves/slopes towards the circumferential flange 54 of the operative component 28 of the male portion 22.

The circumferential flange 54 of the operative component 28 of the male portion 22 has a short skirt portion 60. The short skirt portion 60 of the circumferential flange 54 of the operative component 28 of the male portion 22 extends peripherally therearound projecting towards the outer surface 56 of the base 38 of the operative component 28 of the male portion 22.

The securing component 26 of the male portion 22 further has an axially projecting lip 62. The axially projecting lip 62 of the securing component 26 of the male portion 22 is disposed around a periphery 64 of the flange 37 of the cap 34 of the securing component 26 of the male portion 22, and extends in a direction of the pin 36 of the securing component 26 of the male portion 22.

As shown in FIG. 3, when the securing component 26 of the male portion 22 engages the operative component 28 of the male portion 22 and are secured together, one of the garment pair 12 is clamped between the short skirt portion 60 of the circumferential flange 54 of the operative component 28 of the male portion 22 and the axially projecting lip 62 of the securing component 26 of the male portion 22 and is forced out of a flat condition by engagement with the outer surface 56 of the base 38 of the operative component 28 of the male portion 22 to thereby increase security of clamping action and minimize a possibility of relative movement between one of the garment pair 12 and the male portion 22 to thereby minimize possible fatigue failure of one of the garment pair.

The flange 37 of the cap 34 of the securing component 26 of the male portion 22 is dished so as to have a diaphragm effect and compensate for loss of tension on one of the garment pair 12 after the pin 36 of the securing component 26 of the male portion 22 has been deformed into a secured condition.

This is achieved by the cap 34 of the securing component 26 of the male portion 22 sloping outwardly and towards the terminal end 39 of the pin 36 of the securing component 26 of the male portion 22, with the flange 37 of the cap 34 of the securing component 26 of the male portion 22, preferably, having some flexibility so as to permit resilient distortion in an engaged position and ensure firm clamping of one of the garment pair 12 between the securing component 26 of the male portion 22 and the operative component 28 of the male portion 22.

F. The Specific Configuration of the Female Portion 24 of the Snap Fastener 20.

The specific configuration of the female portion 24 of the snap fastener 20 can best be seen in FIG. 6, which is an exploded diagrammatic side elevational view of the female portion of the snap fastener of the fastener of the pairing and indexing system of the embodiments of the present invention shown in FIG. 4, and as such, will be discussed with reference thereto.

Since the securing component 30 of the female portion 24 is identical to the securing component 26 of the male portion 22, and since the securing component 26 of the male portion 22 has already been discussed, for the sake of brevity, the securing component 26 of the female portion 24 will not be discussed.

The operative component 32 of the female portion 24 has a base 66. The base 66 of the operative component 32 of the female portion 24 has a tubular section 68. The tubular section 68 of the operative component 32 of the female portion 24 is substantially cylindrical, projects axially from one side of the base 66 of the operative component 32 of the female portion 24, and defines an open-mouthed cavity 70 that receives the stud 40 of the operative component 28 of the male portion 22.

The operative component 32 of the female portion 24 further has a plurality of lip sections 72. The plurality of lip sections 72 of the operative component 32 of the female portion 24 are disposed circumferentially around the open-mouth cavity 70 of the tubular section 68 of the operative component 32 of the female portion 24, and provide a means for snap engaging with the circumferential snap engaging bead 48 of the stud 40 of the operative component 28 of the male portion 22.

Each of the plurality of lip sections 72 of the operative component 32 of the female portion 24 extends circumferentially of the open-mouth cavity 70 of the tubular section 68 of the operative component 32 of the female portion 24 and, preferably, has a maximum radial inward projection at a region 74 that is substantially midway in the plurality of lip sections 72 of the operative component 32 of the female portion 24.

Each of the plurality of lip sections 72 of the operative component 32 of the female portion 24 distorts to facilitate insertion and withdrawal of the stud 40 of the operative component 28 of the male portion 22, while allowing for a less critical fit of the securing component 30 of the female portion 24 and the operative component 32 of the female portion 24 to thereby aid manufacture.

The base 66 of the operative component 32 of the female portion 24 has a central opening 76. The central opening 76 of the base 66 of the operative component 32 of the female portion 24 receives the pin 36 of the securing component 30 of the female portion 24.

It is preferred that further material locking means be provided so as to provide a secure clamping of one of the garment pair 12 between the male portion 22 and the female portion 24.

To this end, the operative component 32 of the female portion 24 has a circumferential flange 78 and a skirt portion 80.

The outer surface 80 of the base 66 of the operative component 32 of the female portion 24 is disposed axially beyond the skirt portion 80 of the operative component 32 of the female portion 24.

The pin 36 of the securing component 30 of the female portion 24 is projected through the base 66 of the operative component 32 of the female portion 24, and then deformed or flattened at the terminal end 39 of the pin 36 of the securing component 30 of the female portion 24 to bear against an inner surface of the base 66 of the operative component 32 of the female portion 24, and a degree of deformation is, preferably, that the deformed terminal end 39 of the pin 36 of the securing component 30 of the female portion 24 fits within the interior 44 of the stud 40 of the operative component 28 of the male portion 22.

The stud 40 of the operative component 28 of the male portion 22 and the open-mouth cavity 70 of the tubular section 68 of the operative component 32 of the female portion 24 are of related dimensions so as to allow the circumferential snap engaging bead 48 of the stud 40 of the operative component 28 of the male portion 22 to snapingly engage behind the plurality of lip sections 72 of the operative component 32 of the female portion 24.

G. The Impressions.

It will be understood that each of the elements described above or two or more together may also find a useful application in other types of constructions differing from the types described above.

While the embodiments of the present invention have been illustrated and described as embodied in a pairing and indexing system for a garment pair, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

TABLE I

| EXAMPLES | ATTRIBUTE (18) OF SNAP FASTENER (20) | CORRELATING CHARACTERISTIC (16) OF GARMENT PAIR (12) |
|---|---|---|
| I | Color group A | Fabric type |
| II | Color group B | Weave type |
| III | Color group C | Feel |
| IV | Color group D | Durability |
| V | Color group E | Color |
| VI | Color group F | Weight |
| VII | Color group G | Warmth |
| VIII | Color group H | Luster |
| IX | Color group I | Fluffiness |
| X | Color group J | Surface finish |
| XI | Color group K | Reversibility |
| XII | Color group L | Ability to shed dirt |
| XIII | Color group M | Ability to resist shrinking |
| XIV | Color group N | Ability to resist sagging |
| XVI | Color group O | Ability to hold a crease |
| XVII | Color group P | Ability to shine with wear |
| XVIII | Color group Q | Crispness |
| XIX | Color group R | Elasticity |
| XX | Color group S | Ability to be washed |
| XXI | Color group T | Absorbency |
| XXII | Color group U | Ability to dry |
| XXIII | Color group V | Ability to be dyed |
| XIV | Color group W | Ability to resist wrinkling |
| XV | Color group X | Ability to be crushed |
| XVI | Color group Y | Ability to be pressed |
| XVII | Color group Z | Ability to resistant creasing |
| XVIII | Color group AA | Ability to resist stretching |
| XXIX | Color group BB | Ability to resist mildew |
| XXX | Color group CC | Ability to resist abrasion |
| XXXI | Color group DD | Ability to resist moths |
| XXXII | Color group EE | Ability to resist melting |
| XXXIII | Color group FF | Ability to resist bleaches, perspiration, oils, detergents, and chemicals |
| XXXIV | Color group GG | Stiffness |
| XXXV | Color group HH | Flexibility |
| XXXVI | Color group II | Ability to resist water |

TABLE II

| EXAMPLE V | | | |
|---|---|---|---|
| | ATTRIBUTE (18) OF SNAP FASTENER (20) - COLOR GROUP E | | |
| COMBINATION | COLOR OF SECURING COMPONENT (26) OF MALE PORTION (22) OF SNAP FASTENER (20) AND COLOR OF SECURING COMPONENT (30) OF FEMALE PORTION (24) OF SNAP FASTENER (20) | COLOR OF OPERATIVE COMPONENT (28) OF MALE PORTION (22) OF SNAP FASTENER (20) AND COLOR OF OPERATIVE COMPONENT (32) OF FEMALE PORTION (24) OF SNAP FASTENER (20) | CORRELATING COLOR CHARACTERISTIC OF GARMENT PAIR (12) |
| 1 | Color 1 | Color 1 | Color 1 |
| 2 | Color 2 | Color 2 | Color 2 |

TABLE II-continued

| EXAMPLE V | | | |
|---|---|---|---|
| | ATTRIBUTE (18) OF SNAP FASTENER (20) - COLOR GROUP E | | |
| COMBINATION | COLOR OF SECURING COMPONENT (26) OF MALE PORTION (22) OF SNAP FASTENER (20) AND COLOR OF SECURING COMPONENT (30) OF FEMALE PORTION (24) OF SNAP FASTENER (20) | COLOR OF OPERATIVE COMPONENT (28) OF MALE PORTION (22) OF SNAP FASTENER (20) AND COLOR OF OPERATIVE COMPONENT (32) OF FEMALE PORTION (24) OF SNAP FASTENER (20) | CORRELATING COLOR CHARACTERISTIC OF GARMENT PAIR (12) |
| 3 | Color 3 | Color 3 | Color 3 |
| 4 | Color 4 | Color 4 | Color 4 |
| 5 | Color 5 | Color 5 | Color 5 |

TABLE III

| EXAMPLE VI | | | |
|---|---|---|---|
| | ATTRIBUTE (18) OF SNAP FASTENER (20) - COLOR GROUP F | | |
| COMBINATION | COLOR OF SECURING COMPONENT (26) OF MALE PORTION (22) OF SNAP FASTENER (20) AND COLOR OF SECURING COMPONENT (30) OF FEMALE PORTION (24) OF SNAP FASTENER (20) | COLOR OF OPERATIVE COMPONENT (28) OF MALE PORTION (22) OF SNAP FASTENER (20) AND COLOR OF OPERATIVE COMPONENT (32) OF FEMALE PORTION (24) OF SNAP FASTENER (20) | CORRELATING WEIGHT CHARACTERISTIC OF GARMENT PAIR (12) |
| 1 | Color 1 | Color 2 | Light |
| 2 | Color 2 | Color 3 | Median |
| 3 | Color 3 | Color 4 | Heavy |

The invention claimed is:

1. A pairing and indexing system for a garment pair, comprising:

a) a garment pair; and b) a fastener;

wherein said garment pair has at least one characteristic;

wherein said fastener is attached to said garment pair;

wherein said fastener replaceably attaches said garment pair to each other for pairing;

wherein said fastener has at least one attribute;

wherein each of said at least one attribute of said fastener has a predetermined correlation to a respective one of said at least one characteristic of said garment pair;

wherein said fastener is a snap fastener;

wherein said snap fastener comprises:

c) a male portion; and d) a female portion;

wherein said male portion of said snap fastener is attached to one of said garment pair, while said female portion of said snap fastener is attached to the other of said garment pair so as to allow said snap fastener to replaceably attach said garment pair to each other for pairing;

wherein said male portion of said snap fastener has:

e) a securing component; and f) an operative component;

wherein said securing component of said male portion of said snap fastener engages said operative component of said male portion of said snap fastener, with one of said garment pair securely captured therebetween;

wherein said operative component of said male portion has a base of circular shape and a circumferential flange;

wherein said base of said operative component of said male portion has a radial outer portion; and wherein said radial outer portion of said base of said operative component of said male portion curves and slopes towards said circumferential flange of said operative component of said male portion.

2. The system of claim 1, wherein said garment pair is one of socks, gloves, and hosiery.

3. The system of claim 1, wherein said at least one attribute of said fastener is color.

4. The system of claim 1, wherein said female portion of said snap fastener has:

a) a securing component; and b) an operative component;

wherein said securing component of said female portion of said snap fastener engages said operative component of said female portion of said snap fastener, with the other of said garment pair securely captured therebetween.

5. The system of claim 4, wherein said securing component of said male portion of said snap fastener and said securing component of said female portion of said snap fastener are identical to thereby simplify manufacture and assembly with attendant saving in cost.

6. The system of claim 1, wherein said snap fastener is molded plastic so as to be resistant to corrosive environments, easily colored to suit requirements, have a low heat conductivity, and be electrically insulating.

7. The system of claim 4, wherein said securing component of each of said male portion and said female portion has a cap; and wherein said cap of said securing component of each of said male portion and said female portion is disk-like.

8. The system of claim 7, wherein said cap of said securing component of each of said male portion and said female portion has a flange of circular shape.

9. The system of claim 1, wherein said operative component of said male portion has a stud;

wherein said stud of said operative component of said male portion is hollow;

wherein said stud of said operative component of said male portion is cylindrical; and wherein said stud of said operative component of said male portion extends axially from one side of said base of said operative component of said male portion.

10. The system of claim 9, wherein said stud of said operative component of said male portion has an interior;

wherein said interior of said stud of said operative component of said male portion is open and accessible from an outer end of said stud of said operative component of said male portion; and wherein said outer end of said stud of said operative component of said male portion is remote from said base of said operative component of said male portion.

11. The system of claim 10, wherein said stud of said operative component of said male portion has a circumferential snap engaging bead;

wherein said circumferential snap engaging bead of said stud of said operative component of said male portion is disposed around an external surface of said stud of said operative component of said male portion, at said outer end of said stud of said operative component of said male portion; and wherein said circumferential snap engaging bead of said stud of said operative component of said male portion cooperatively engages with said female portion.

12. The system of claim 8, wherein said circumferential flange of said operative component of said male portion has a short skirt portion; and wherein said short skirt portion of said circumferential flange of said operative component of said male portion extends peripherally therearound projecting towards an outer surface of said base of said operative component of said male portion.

13. The system of claim 12, wherein said securing component of each of said male portion and said female portion has an axially projecting lip;

wherein said axially projecting lip of said securing component of each of said male portion and said female portion is disposed around a periphery of said flange of said cap of said securing component of an associated one of said male portion and said female portion.

14. The system of claim 13, wherein when said securing component of each of said male portion and said female portion engages said operative component of an associated one of said male portion and said female portion and are secured together, a respective one of said garment pair is clamped between said short skirt portion of said circumferential flange of said operative component of said male portion and said axially projecting lip of said securing component of an associated one of said male portion and said female portion and is forced out of a flat condition by engagement with an outer surface of said base of said operative component of said male portion to thereby increase security of clamping action and minimize a possibility of relative movement between a respective one of said garment pair and said male portion to thereby minimize possible fatigue failure of said garment pair.

15. The system of claim 14, wherein said operative component of said female portion has a base;

wherein said base of said operative component of said female portion has a tubular section;

wherein said tubular section of said operative component of said female portion is substantially cylindrical;

wherein said tubular section of said operative component of said female portion projects axially from one side of said base of said operative component of said female portion; and wherein said tubular section of said operative component of said female portion defines an open-mouth cavity that receives said stud of said operative component of said male portion.

16. The system of claim 15, wherein said operative component of said female portion has a plurality of lip sections;

wherein said plurality of lip sections of said operative component of said female portion are disposed circumferentially around said open-mouth cavity of said tubular section of said operative component of said female portion; and wherein said plurality of lip sections of said operative component of said female portion provide a means for snap engaging with said circumferential snap engaging bead of said stud of said operative component of said male portion.

17. The system of claim 16, wherein each of said plurality of lip sections of said operative component of said female portion extends circumferentially of said open-mouth cavity of said tubular section of said operative component of said female portion.

18. The system of claim 17, wherein each of said plurality of lip sections of said operative component of said female portion has a maximum radial inward projection at a region that is substantially midway in said plurality of lip sections of said operative component of said female portion.

19. The system of claim 18, wherein each of said plurality of lip sections of said operative component of said female portion distorts to facilitate insertion and withdrawal of said stud of said operative component of said male portion, while allowing for a less critical fit of said securing component of said female portion and said operative component of said female portion to thereby aid manufacture.

20. The system of claim 19, wherein said base of said operative component of said female portion has a central opening; and wherein said central opening of said base of said operative component of said female portion receives said pin of said securing component of said female portion.

21. The system of claim 20, wherein said operative component of said female portion has:

a) a circumferential flange; and b) a skirt portion.

22. The system of claim 21, wherein said outer surface of said base of said operative component of said female portion is disposed axially beyond said skirt portion of said operative component of said female portion.

* * * * *